US006227981B1

(12) United States Patent
Lizama Troncoso et al.

(10) Patent No.: US 6,227,981 B1
(45) Date of Patent: May 8, 2001

(54) BALL RAMP ASSEMBLY

(75) Inventors: Mauricio Anibal Lizama Troncoso, Rio Piedras; David Serrano, San Juan; Joel Rivera, Bayamón; José Soto, Dorado; Raul Jordan, Guaynabo; Lorenzo Detres, Maricao, all of PR (US)

(73) Assignee: University of Puerto Rico, San Juan, PR (US)

( * ) Notice: Subject to any disclaimer, the term of this patent is extended or adjusted under 35 U.S.C. 154(b) by 0 days.

(21) Appl. No.: 09/251,479

(22) Filed: Feb. 17, 1999

Related U.S. Application Data

(60) Provisional application No. 60/075,039, filed on Feb. 19, 1998.

(51) Int. Cl.[7] ..... A63D 5/00

(52) U.S. Cl. ..... 473/56; 473/54; 473/58

(58) Field of Search ..... 473/541, 56–58; 280/304.1; 345/156

(56) References Cited

U.S. PATENT DOCUMENTS

| | | | | |
|---|---|---|---|---|
| 3,083,967 | | 4/1963 | Steel . | |
| 3,159,401 | * | 12/1964 | Ikenberry | 473/56 |
| 3,215,436 | | 11/1965 | Carter . | |
| 3,481,601 | | 12/1969 | Santora . | |
| 3,539,183 | | 11/1970 | Lieb . | |
| 3,578,322 | | 5/1971 | Kerr . | |
| 4,097,045 | | 6/1978 | Bechtel . | |
| 4,368,898 | | 1/1983 | Lay . | |
| 4,441,710 | | 4/1984 | Lay . | |
| 4,470,598 | * | 9/1984 | Steele et al. | 473/56 |
| 5,082,265 | | 1/1992 | Bergman . | |
| 5,358,446 | * | 10/1994 | Bergman | 473/56 |
| 5,358,447 | | 10/1994 | Erickson . | |
| 5,713,798 | * | 2/1998 | Brodie, Jr. | 473/55 |
| 6,042,482 | * | 10/1998 | Wilds | 473/56 |

OTHER PUBLICATIONS

*Flaghouse Inc. Products Brochure*, p. 61 (item numbers 9972T, 8341T, and 9977T).

* cited by examiner

*Primary Examiner*—Stephen F. Gerrity
*Assistant Examiner*—Mitra Aryanpour
(74) *Attorney, Agent, or Firm*—Patent Law Office of Heath W. Hoglund

(57) ABSTRACT

The present invention contemplates an improved ball ramp assembly that enables even the most severely handicapped bowler to guide and accelerate a bowling ball toward the intended bowling pins. The bowling ramp assembly includes a ramp having a ball guide defining a ball path along the ramp, a base coupled to a proximal end of the ramp for supporting the ramp, a ball release coupled to the ramp for selectively controlling travel of the ball along the ramp, and a positioning assembly coupled to the ramp for adjusting the orientation of the ramp. The ball release includes a ball stopping member that moves between a ball blocking position and a ball releasing position. The positioning assembly includes at least one motor coupled to the ramp and a wheel located at the distal end of the ramp. The ball release and positioning assembly are both controlled by switches which may be located remotely from the ramp.

10 Claims, 8 Drawing Sheets

BALL RAMP ASSEMBLY

This application relies on the benefit of U.S. provisional patent application Ser. No. 60/075,039, filed on Feb. 19, 1998, the disclosure of which is incorporated herein by reference.

BACKGROUND OF THE INVENTION

1. Field of the Invention

The present invention relates to ball ramp assemblies and, more particularly, to bowling ramp assemblies designed for use by bowlers having limited use of their arms or hands.

2. Description of the Related Art

A number of inventions exist which are aimed at helping the disabled to bowl. U.S. Pat. Nos. 5,358,447 to Erickson; 4,097,045 to Bechtel; 4,368,898 to Lay; and 4,441,710 to Lay all show bowling ramps which can be placed on the front of a wheelchair or on a support structure which a person stands behind. These ramps require the person to have some sort of mobility in the arms and hands in order to place the bowling ball on the ramp, hold the ball while the ramp is positioned in the desired direction for bowling, and then release the ball in order that the ball will roll down the ramp towards the pins.

U.S. Pat. No. 5,358,446 to Bergman shows a bowling ramp in which the top of the ramp is horizontal. In this design, a person does not need to hold the ball to prevent it from inadvertently falling down the ramp, but does need to provide a pushing force in order to direct or initiate movement of the ball down the ramp. All of these known devices could not be used by a person that does not have adequate control of their arms or hands to hold the ball and release it down the ramp, or to push the ball down the ramp.

Further, the bowling ramp assemblies of the relevant art fail to provide a ramp positioning assembly that adequately takes into account the infirmities of the handicapped bowler. For example, Bergman discloses a bowling ramp having a clamp assembly located at the bottom back end of the ramp that allows the bowler to reposition the ramp to target specific bowling pins without shifting the entire ramp. Such an arrangement is impracticable for those disabled bowlers that lack the strength and dexterity to release the clamp assembly, reposition the ramp, and fix the clamp assembly.

Even assuming a handicapped bowler is capable of repositioning the ramp of Bergman, the location of the clamp assembly at the bottom back end of the ramp makes it difficult for such a bowler to access it. This location is particularly cumbersome for bowlers restricted to a wheelchair.

SUMMARY OF THE INVENTION

An object of the invention is to provide a ball ramp assembly that enables even the most severely handicapped bowler to guide and accelerate a bowling ball toward the bowling pins. It should be understood that the invention could still be practiced without performing this preferred object.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purposes of the invention, as embodied and broadly described herein, the invention comprises a ramp assembly for guiding and accelerating a ball. The ramp assembly includes a ramp having a proximal end, a distal end, and a ball guide, the ball guide defining a ball path along the ramp, a base coupled to the proximal end of the ramp for supporting the ramp, a ball release coupled to the ramp for selectively controlling travel of the ball along the ramp, and a positioning assembly coupled to the ramp for adjusting the orientation of the ramp.

In accordance with another aspect, the present invention also comprises a ramp assembly for guiding and accelerating a ball. This ramp assembly includes a ramp having a proximal end, a distal end, and a ball guide, the ball guide defining a ball path down the ramp, a base located at the proximal end of the ramp for supporting the ramp, a ball release coupled to the ramp, the ball release including a stopping member movable between a blocking position restricting the ball from traveling along the ball guide, and a releasing position allowing the ball unrestricted travel along the ball guide, and a switch coupled to the ball release for selectively controlling the position of the stopping member.

In accordance with yet another aspect, the present invention again comprises a ramp assembly for guiding and accelerating a ball. The ramp assembly includes a ramp having a proximal end, a distal end, and a ball guide, the ball guide defining a ball path along the ramp, a base located at the proximal end of the ramp for supporting the ramp, and a motor driven positioning assembly coupled to the ramp for adjusting the orientation of the ramp.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
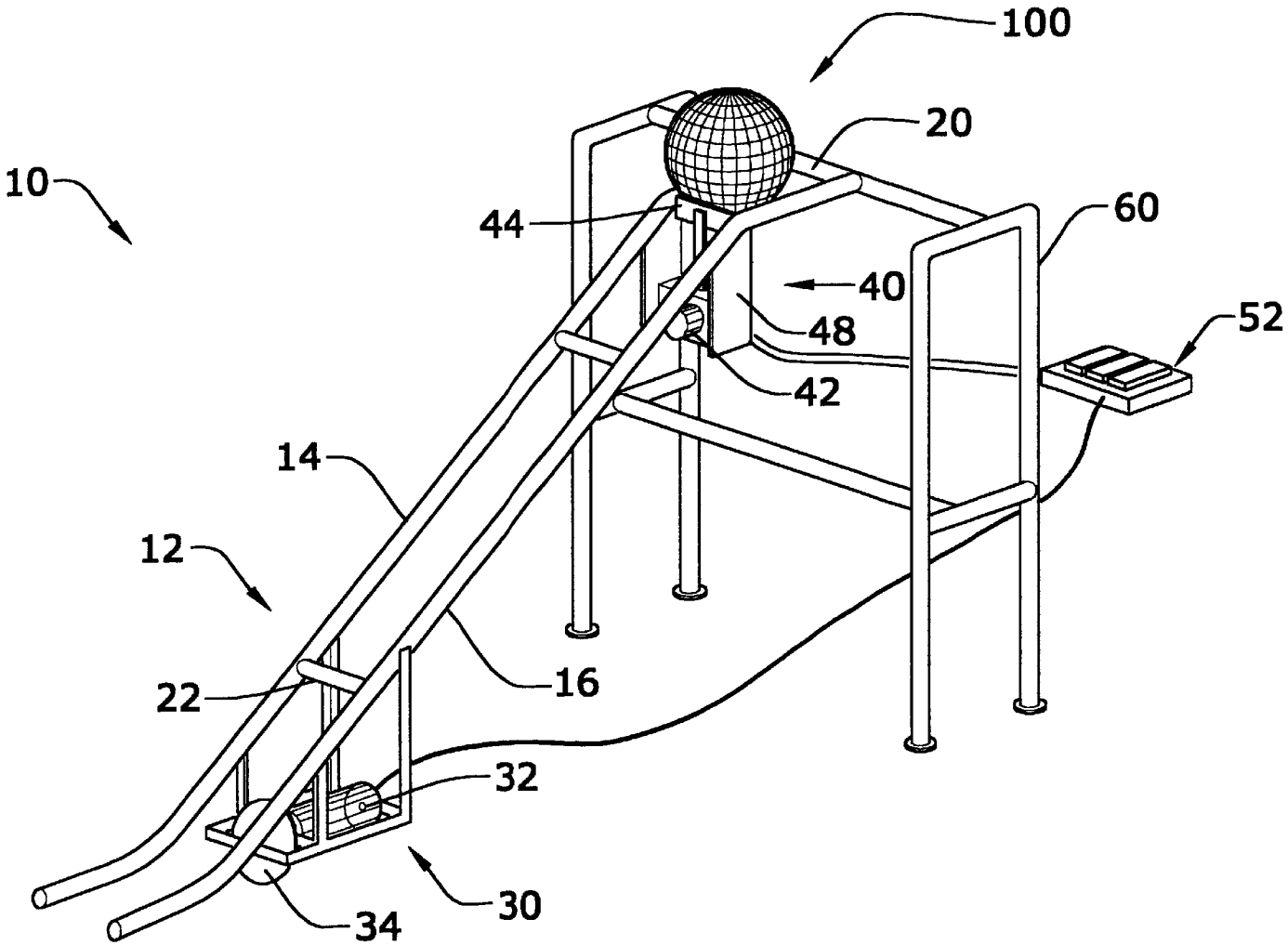
FIG. 1 is a perspective view of a ramp assembly according to a first embodiment of the present invention.
Figure 2:
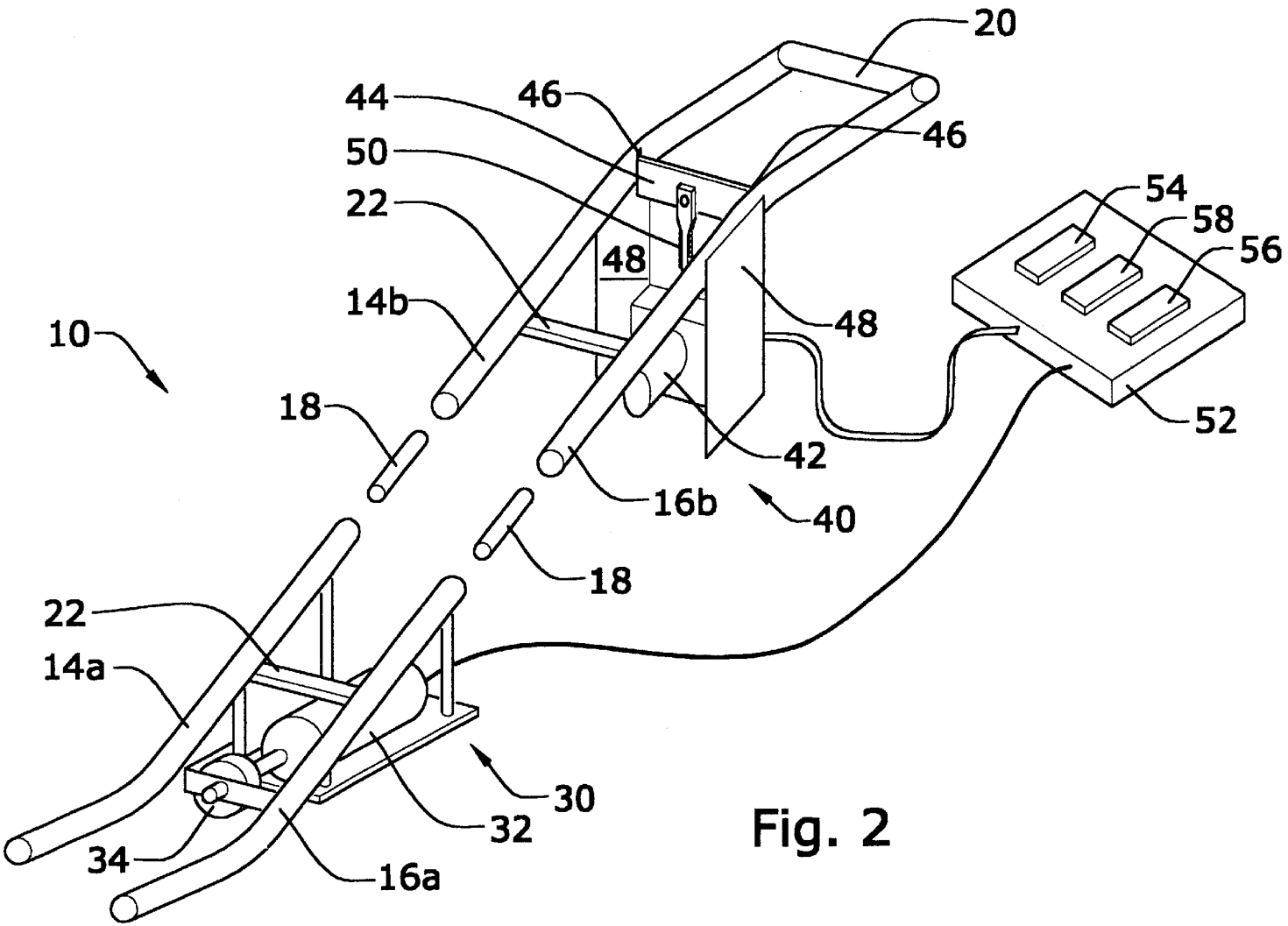
FIG. 2 is a partial exploded view of the ramp and control box of the ramp assembly of FIG. 1.

Referring to FIGS. 1 and 2, a ramp assembly according to a first embodiment of the present invention is generally indicated at 10 and includes a ramp 12 formed from two identical rails 14 and 16. Each rail is comprised of two sub-rails 14*a* and 14*b* and 16*a* and 16*b* (FIG. 2). These rails may be, for example, made of ¾ inch metal tubing and joined together by a straight joiner tube 18. A cross bar 20 joins rails 14 and 16 together at the top, proximal end of ramp 12. Cross bar 20 is connected to rail members 14 and 16 by, for example, a union elbow (not shown). A plurality of support bars 22 are spaced along rails 14, 16 and provide rigid support to the rails. Rails 14, 16 are spaced at a proper distance to form a ball guide which defines a ball path along ramp 12.

A positioning assembly 30 is secured to the lower, distal portion of ramp 12, while a ball release 40 is mounted to the upper, proximal portion of ramp 12. An electric motor 32 is part of the positioning assembly 30 and is used to position ramp 12 at a desired angle of orientation. Release mechanism 40 holds a bowling ball 100 on ramp 12 and releases the ball at a desired time. A control box 52 is electrically connected to the electric motor 32 and ball release 40 for control purposes. A ramp base 60 is pivotally connected to the ramp 12 to support the ramp at the proper height and allow ramp 12 to move with respect to the base upon actuation of electric motor 32.

Ball release 40 is shown in detail in FIG. 2 and includes a solenoid 42 and a stopping member 44. Stopping member 44 is located along the ball guide formed by rails 14,16 at a location distal with respect to an initial, starting position of ball 100. Stopping member 44 rides through cutout sections 46 in rails 14 and 16. Solenoid 42 is secured to ramp 12 by side plates 48. A spring 50 biases the stopping member 44 into a blocking position to hold the ball on the ramp. When the solenoid 42 is activated, the stopping member 44 is retracted out of the way of the ball, and the ball is released down the ball guide formed by rails 14,16 of ramp 12. This position of stopping member 44 is the releasing position.

Ball release 40 includes, for example, a 12 V DC solenoid motor 42 which drives a shaft. The shaft is connected to stopping member 44 which engages the ball on ramp 12. Thus, when solenoid 42 is off (inactive), stopping member 44 is fully extended. When solenoid 42 is activated, stopping member 44 is retracted to permit the ball to travel down the ramp.

Also shown in FIG. 2, positioning assembly 30 includes an electric motor drive system having an electric motor 32 and a drive wheel 34. Electric motor 32 may be, for example, a 3.6 V DC reversible motor with a ¼ inch drive shaft. Attached to a distal end of the motor shaft is wheel 34. Wheel 34 may be, for example, a 5 inch diameter rubber wheel caster having a width of 2 inches. Electric motor 32 is reversible so that the ramp can be driven leftward or rightward to position the ramp at the desired angle of orientation. Motor 32 is positioned just above the bowling lane so as not to make contact. Wheel 34 is of such diameter that it makes contact with the lane while holding the distal ends of ramp 12 slightly above and off the lane.

FIG. 2 also shows ball release 40 and positioning assembly 30 connected to the control box 52. The control box 52 preferably includes three switches. The outer two switches 54, 56 preferably control electric motor 32, while the middle switch 58 preferably controls solenoid 42 of the ball release 40. When the left-most switch 56 is pushed, the motor 32 turns such that ramp 12 is pivoted about base 60 toward the left. When the right-most switch 54 is pushed, the motor 32 turns such that ramp 12 pivots about base 60 toward the left. When the middle switch 58 is pushed, solenoid 42 retracts stopping member 44 in order to release the ball.

Figure 3A:
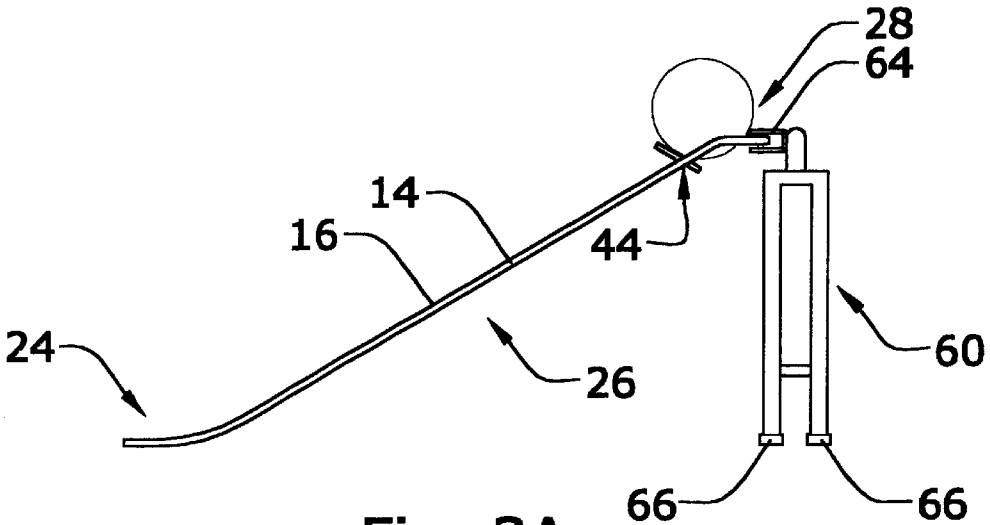
FIG. 3A is a side view of the of the ramp assembly of FIG. 1.
Figure 3B:
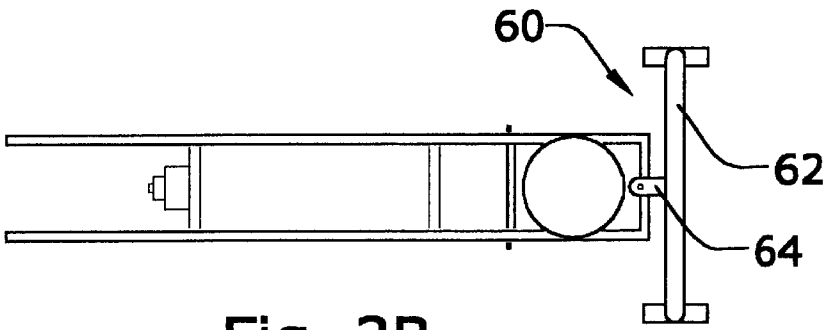
FIG. 3B is a top view of the ramp assembly of FIG. 1.
Figure 3C:
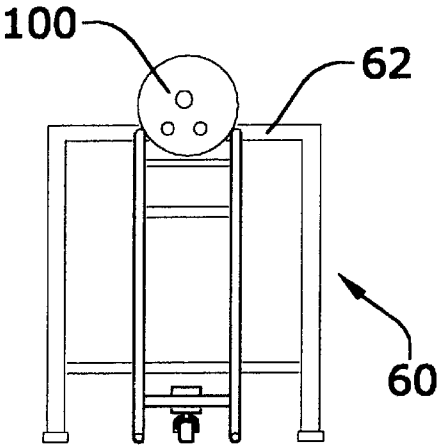
FIG. 3C is a front view of the ramp assembly of FIG. 1.

As shown in FIGS. 3A–3C, ramp base 60 includes a top cross bar 62 with a pivot support bracket 64 mounted thereon. Cross bar 20 of ramp 12 is pivotally mounted to base 60 by support bracket 64. For example, a hole may be formed in cross bar 20, and a pin or bolt inserted through the hole and pivot support bracket 64 to allow for the pivoting motion of ramp 12 with respect to base 60. Ramp base 60 may be formed of, for example, various straight sections of EMT tubing having ¾ inch diameter and 0.049 inch thickness. Other materials can be used for ramp base 60 (and ramp 12) as long as the material is of adequate size and strength to provide support for the ball during operation of the ramp.

As mentioned above, control box 52 preferably includes three control switches 54, 56, 58. These switches may be button type switches (as shown in FIGS. 1 and 2), puff type switches, or head position controlled switches. The puff and head position controlled switches are described in more detail below. The circuit configuration between control box 52, ball release 42, and positioning assembly 30 is of a standard configuration and within the knowledge of one of ordinary skill in the art. Control switches 54, 56, 58 are normally open switches. The rotational speed of electric motor 32 should be slow enough to pivot ramp 12 very slowly such that the bowler will be able to precisely align ramp 12 in the desired orientation. An electric motor that is too fast will cause ramp 12 to be over-positioned, and will thus require constant readjustment of the ramp positioning in order to be an effective bowling device.

By way of example only, the dimensions of ramp assembly 10 may be as follows. Looking to FIGS. 3A–3C, each rail 14, 16 may be formed such that the ramp 12 has a 10 inch horizontal distal section 24, a 57 inch inclined section 26, and a 9 inch horizontal upper section 28 (which is slightly inclined toward the distal end of the ramp so that the ball will not sit on the ramp when stopping member 44 is retracted). Rails 14 and 16 are separated by a distance of 8 inches. Rails 14 and 16 could be made of plurality of straight sections joined together to form the ramp, or a single rail formed with necessary curvature to allow the ball to role along the rails.

The height of ramp base 60 is preferably 30 inches and the width is 36 inches so as to allow a person sitting in a wheelchair to be positioned under the rear of ramp assembly 10 near where the ball is supported on the ramp. At this height, a person in the wheelchair can easily eye the ramp's position and determine the trajectory in which the ball would take upon release. Four rubber tips 66 (FIG. 3A) are connected to the bottoms of ramp base 60 in order to cushion and prevent slippage of the base on the bowling alley floor. FIG. 3C shows a front view of the ramp with bowling ball 100 supported thereon.

Figure 4C:
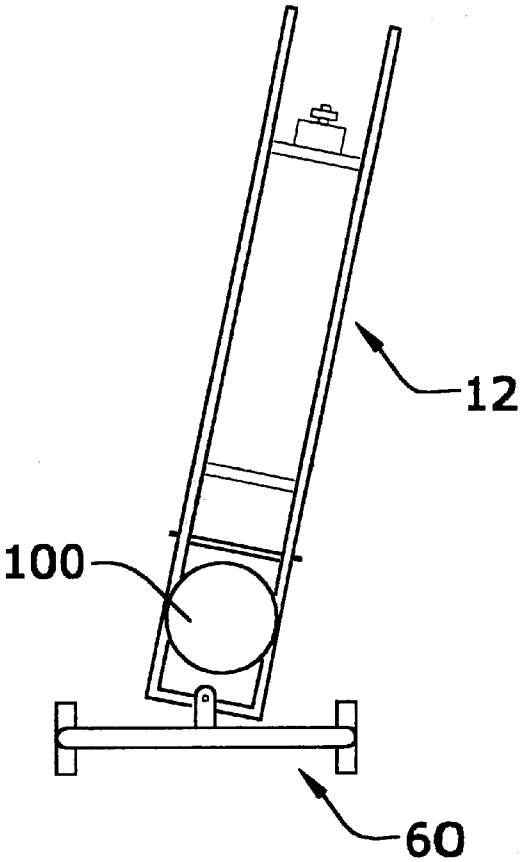
FIG. 4A–4C are top views of the ramp assembly of FIG. 1 at different ramp orientations.
Figure 4B:
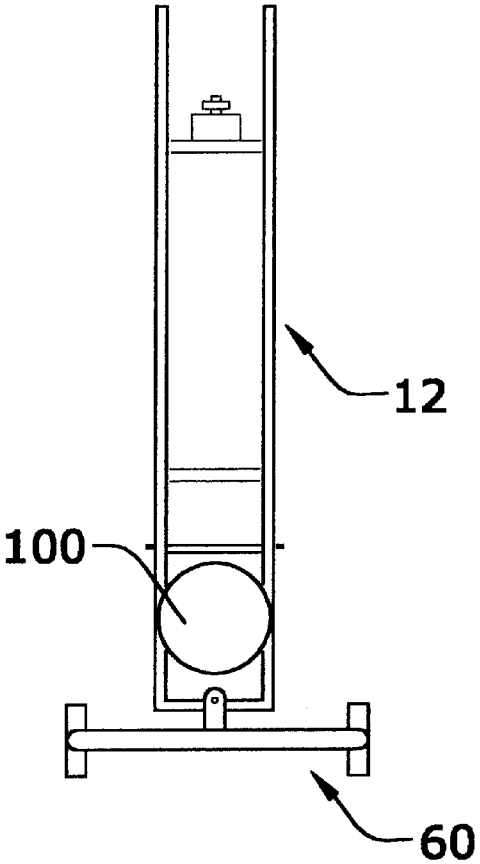
Figure 4A:
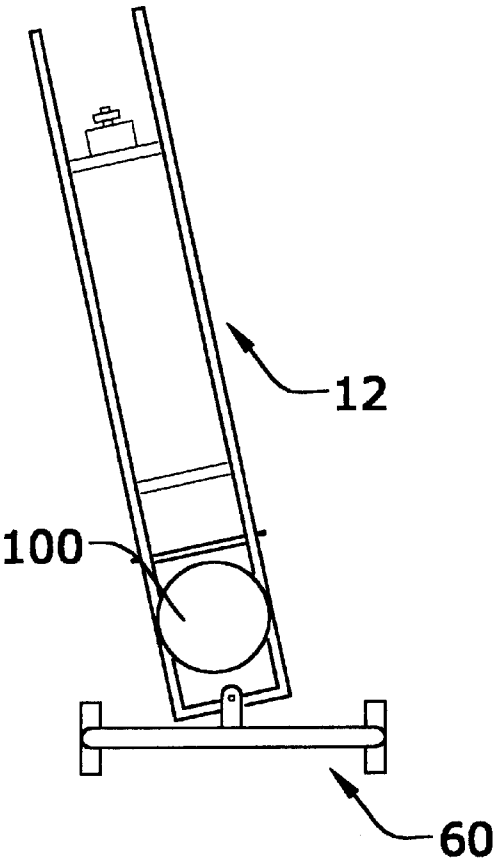

Several positions of ramp assembly 10 of the first embodiment are shown in FIGS. 4A–4C. Ramp 12 is pivoted towards the left, center and right of the lane to project ball 100 along the intended direction. A person sitting or standing behind ramp base 60 would not interfere with or be interfered by the pivoting movement of ramp 12 because base 60 remains stationary.

Figure 5A:
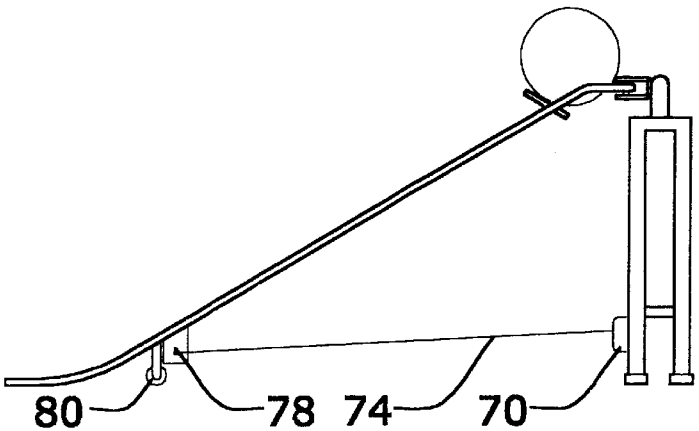
FIG. 5A is a side view of a ramp assembly according to a second embodiment of the present invention.
Figure 5B:
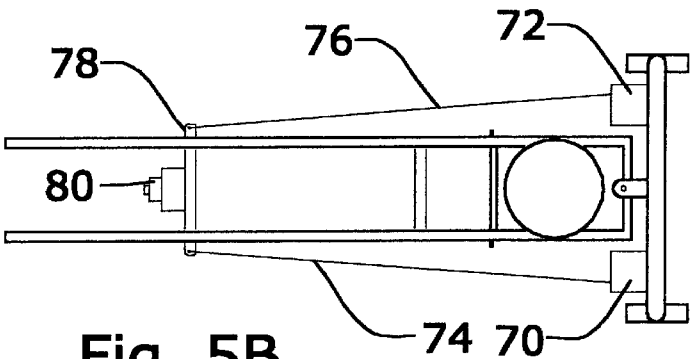
FIG. 5B is a top view of the ramp assembly of FIG. 5A.
Figure 5C:
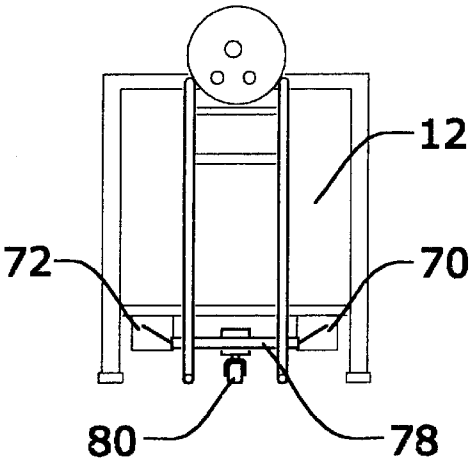
FIG. 5C is a front view of the ramp assembly of FIG. 5A.

A second embodiment of the ramp assembly is shown in FIGS. 5A–5C. Instead of orientating ramp 12 by an electric motor 32 and driven wheel 34, as set forth in the first embodiment, the second embodiment uses two motors 70, 72 connected to base 60 on each side of the ramp 12. Each motor 70, 72 is connected by a wire 74, 76 to a pivot bar 78 secured at a distal portion of ramp 12. Electric motors 70, 72 pull or release the respective wires 74, 76 in order to pivot ramp 12 into the desired position. A wheel 80 or some other well known assembly or device can be used to support ramp 12 and pivot bar 78 so that the ramp can easily move along the lane.

Figure 6C:
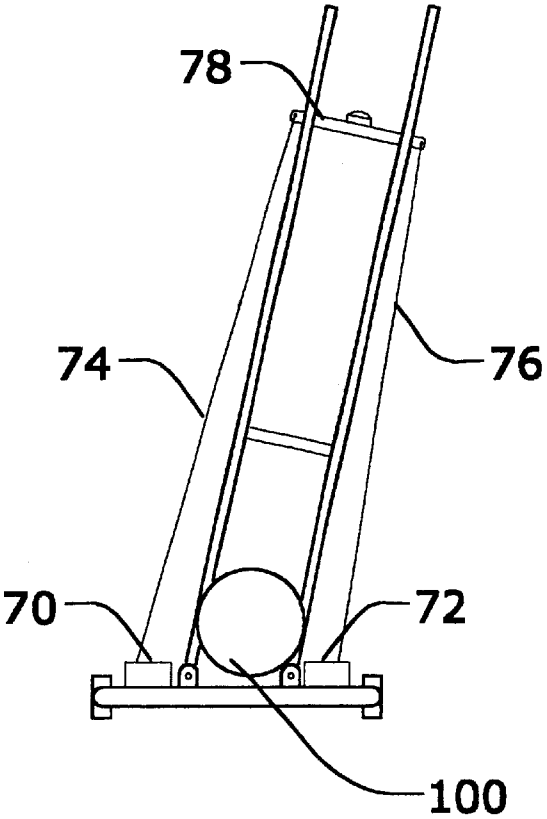
FIG. 6A–6C are top views of the ramp assembly of FIG. 5A at different ramp orientations.
Figure 6B:
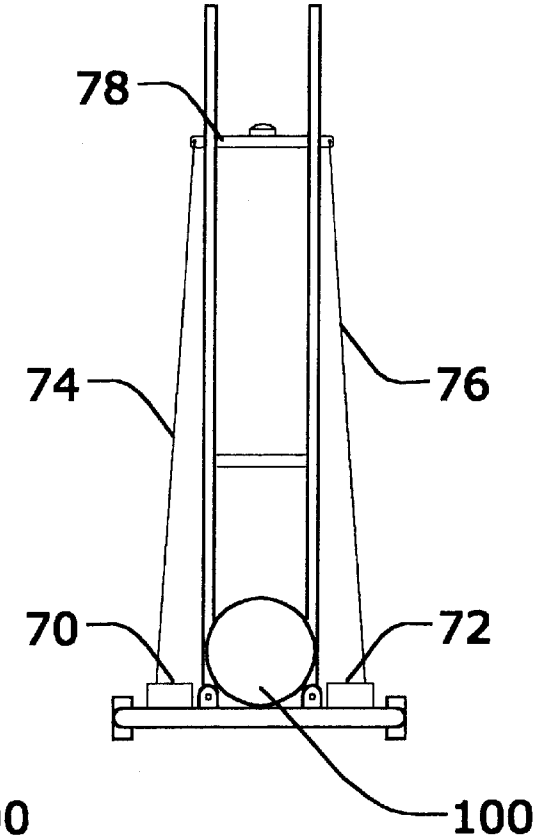
Figure 6A:
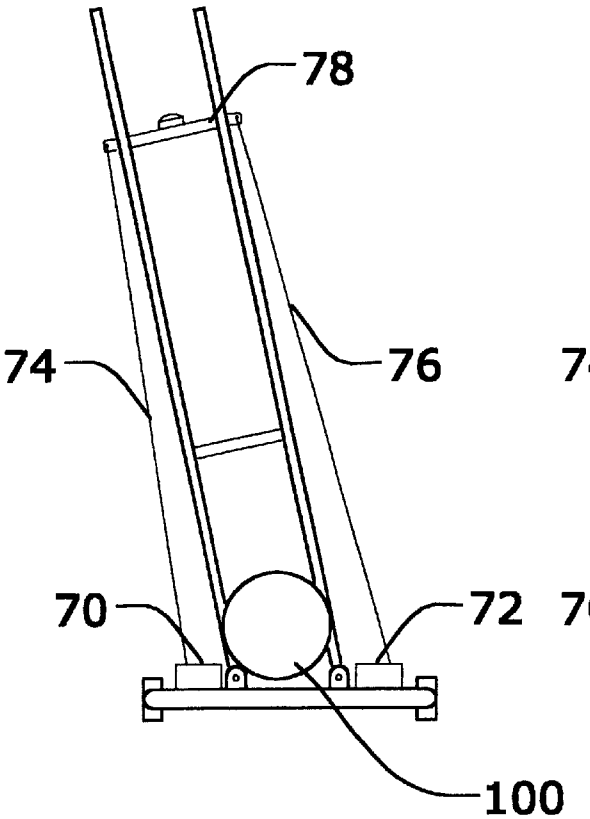

The ball release 40 and the three switch control box 52 of the first embodiment are the same as those of the second embodiment. Activation of right switch button 54 causes motor 72 to pull in the wire 76, while motor 74 would be driven such that its respective wire 78 would be released an equal amount. Various positions of the ramp assembly according to the second embodiment are shown in FIGS. 6A–6C.

Figure 7A:
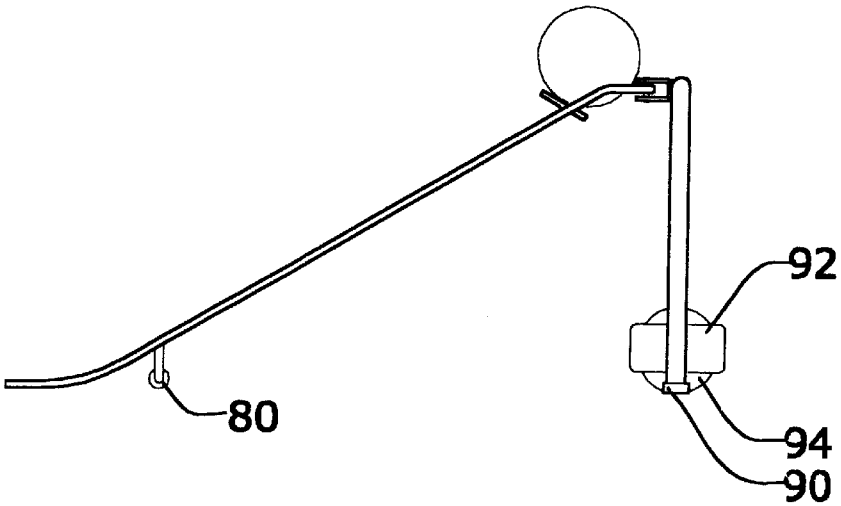
FIG. 7A is a side view of a ramp assembly according to a third embodiment of the present invention.
Figure 7B:
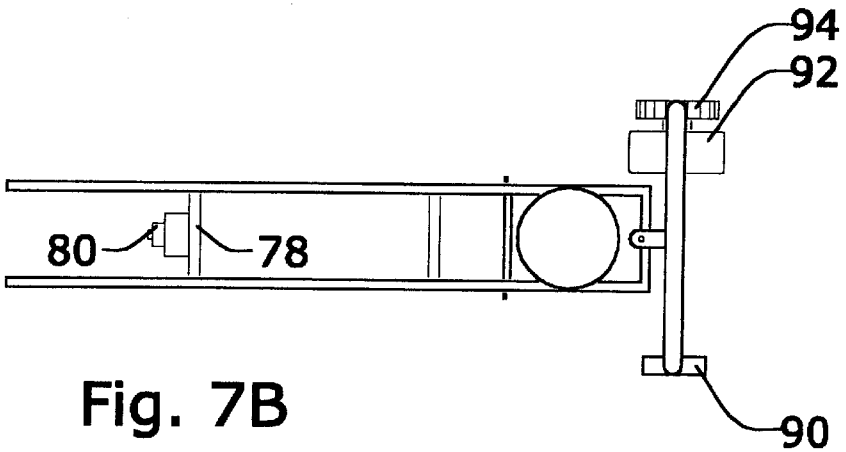
FIG. 7B is a top view of the ramp assembly of FIG. 7A.
Figure 7C:
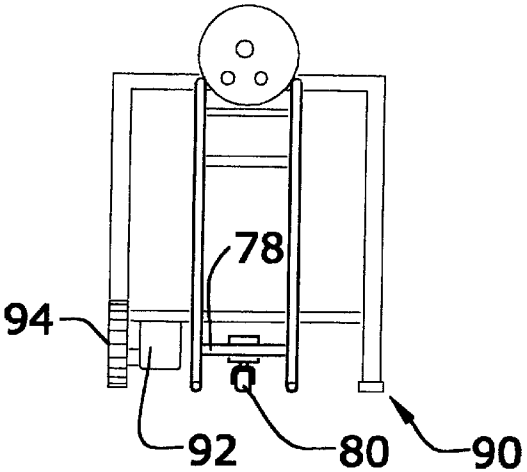
FIG. 7C is a front view of the ramp assembly of FIG. 7A.
Figure 8:
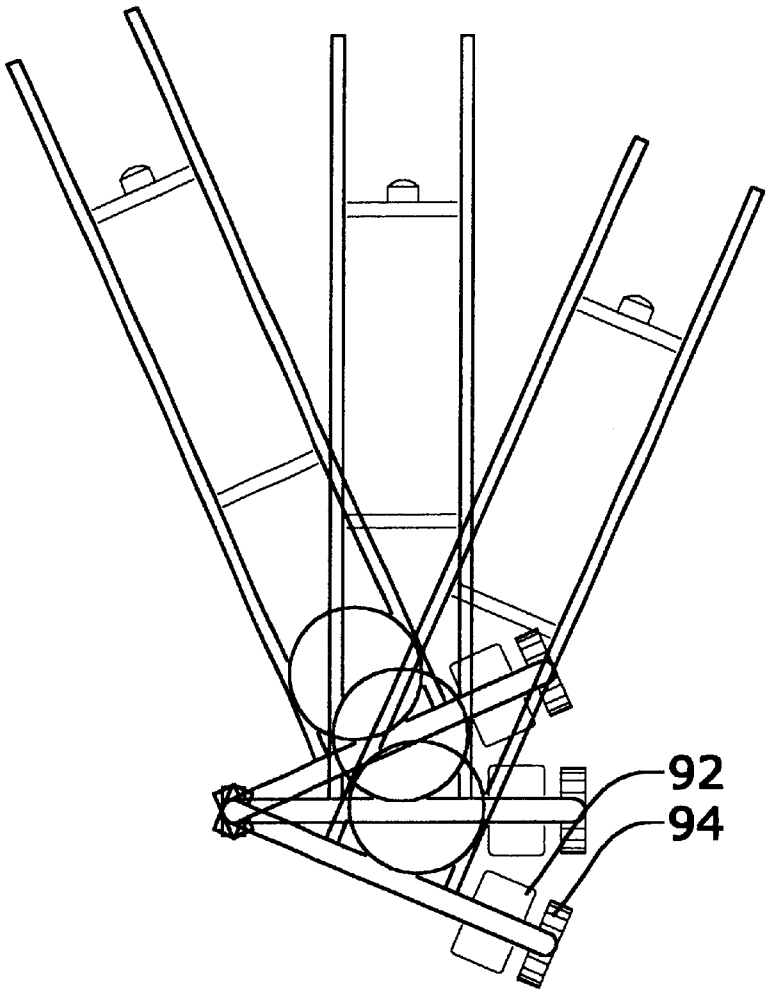
FIG. 8 is a top view of the ramp assembly of FIG. 7A at different ramp orientations.

FIGS. 7A–7C illustrate a third embodiment of the invention. Here, ramp 12 is rigidly fixed to ramp base 60, and the whole is pivoted about a point 90 positioned on one side of base 60. An electric motor 92 connected to a wheel 94 is provided at another side of base 60 to drive ramp 12 and base 60 about pivot point 90 in order to position ramp 12 at the desired orientation. The ball release and control box of the third embodiment are the same as those disclosed in the first embodiment. Pivot bar 78 and wheel assembly 80 of the third embodiment are the same at those described with respect to the second embodiment. FIG. 8 shows the third embodiment of the present invention in various positions about pivot point 90.

Referring back to the first embodiment, in use, a person in a wheelchair would have someone place bowling ball 100 on upper horizontal section 28 of ramp 12 such that the ball is positioned up against stopping member 44. The person in the wheelchair would then position himself behind ramp base support 60 such that he/she has a clear view of the bowling lane from behind bowling ball 100 on ramp assembly 10. The bowler would then push one of the outside two switches 54, 56 to control electric motor 32 such that the ramp is pivoted to the desired position. When the desired position is attained, the bowler would then push middle switch 58 in order to activate solenoid 42 to release bowling ball 100 down ramp 12 and onto the lane towards the pins.

Because of the light weight and portability of the bowling mechanism of the present invention, the mechanism can easily be removed from the lane in order that a person not needing the bowling ramp device can bowl.

In order that a person having severely limited use of his arms and hands can use the ball ramp assembly, control box 52 can be modified to include jacks into which can be plugged any type of ability switches normally used by persons with disabilities, for example, puff switches (not shown). The puff switches allow for the bowler to use his/her breath (positive or negative air pressure from the mouth) to produce the signals to control motor 32 or solenoid 42. In one embodiment, two puff switches can be used. One puff switch signals whether the user is blowing or sucking in the puff switch to control the left or right directional movement of the motor. The other puff switch detects a change in pressure (either negative from sucking or positive from blowing) in order to activate solenoid 42 and release ball 100. Three puff switches can be used—two for each of the right and left control switches 54, 56 and one for solenoid 42.

In yet another embodiment, a head position controlled switch (not shown) can be used in which leftward movement of the head will duplicate the signal of the left side control switch, while rightward movement will duplicate the signal from the right side control switch. This type of head position control switch typically uses mercury switches to close an electrical circuit whenever the head is pivoted beyond a specified angle. One such mercury head control device is shown in U.S. Pat. No. 4,567,479 to Boyd, the disclosure of which is hereby incorporated by reference. Forward movement of the head will duplicate the signal from middle control switch 58. The head position controlled switch can be used in combination with a puff switch such that leftward and rightward motion of the head can be used to drive positioning motor 32, while the puff switch can be used to activate solenoid 42 of ball release 40.

In both the puff switch and the head position controlled switch embodiments above, the puff switches and the head position controlled switch can be connected in parallel to left-middle-right switches 56, 58, 54 of control box 52, or left-middle-right switches 56, 58, 54 can be eliminated completely and replaced with the puff switches and/or the head position controlled switch. The preferred embodiment uses both the left-middle-right switches 56, 58, 54 of control box 52 and input jacks on the control box for puff switches or a head control device.

It will be apparent to those skilled in the art that various modifications and variations can be made with respect to the control aspects of the present invention and in construction of the ball ramp without departing from the scope or spirit of the invention. As an example, the control box may be coupled to the ramp apparatus only by way of wireless signals, such as UF or infrared signal. Thus, control of the ramp assembly could be remotely controlled by a bowler who is unable to be positioned adjacent to the ramp assembly.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A ramp assembly for guiding and accelerating a ball, comprising:

a ramp having a proximal end, a distal end, and a ball guide, the ball guide defining a ball path along the ramp, wherein the ball path descends from the proximal end to the distal end;

a base coupled to the proximal end of the ramp for supporting the ramp, wherein the ramp is pivotally coupled to the base for allowing movement of the ramp with respect to the base;

a ball release coupled to the ramp for selectively controlling travel of the ball along the ramp, wherein the ball release includes:

a stopping m ember coupled to the ramp at a position along the ball guide distal with respect to a ball starting position on the ramp, the stopping member being moveable between a blocking position restricting the ball from traveling along the ball guide toward the distal end of the ramp, and a releasing position allowing the ball unrestricted travel along the ball guide toward the distal end of the ramp; and a switch for selectively controlling the position of the stopping member;

a positioning assembly coupled to the ramp for adjusting the orientation of the ramp, wherein the positioning assembly includes:

a rotatable wheel coupled with the distal portion of the ramp, the wheel being capable of rotating about an axis substantially parallel to the ramp ball guide for allowing movement of the ramp to a desired orientation;

at least one motor coupled to the ramp and to the rotatable wheel for controllably adjusting the ramp to the desired orientation; and a control box housing the switch for selectively controlling the position of the stopping member and a position control operationally coupled with the at least one motor, wherein the position control is configured to actuate the motor in a first and a second direction for controllably adjusting the ramp to the desired orientation.

2. The ramp assembly of claim 1, wherein the ball release further includes a solenoid coupled to the ramp, stopping member, and switch, the solenoid moving the stopping member between the blocking position and the releasing position, and the solenoid being electrically actuated by the switch.

3. The ramp assembly of claim 1, wherein the motor is located at the distal portion of the ramp and includes a rotating shaft having the wheel coupled thereto.

4. The ramp assembly of claim 1, wherein the positioning assembly includes a second rotatable wheel and a motor drivingly coupled to the second wheel, the second wheel and the motor being coupled to the base for controllably orientating the ramp about a pivot point located on the base.

5. The ramp assembly of claim 1, wherein the control box is electrically coupled to the ball release and the positioning assembly, and the control box includes one of a button controlled switch, a puff switch, a head position controlled switch, or any other ability switch.

6. The ramp assembly of claim 1, wherein the base and ramp are constructed of tubes having a strength sufficient to support a bowling ball.

7. A ramp assembly for guiding and accelerating a ball, comprising:

a ramp having a proximal end, a distal end, wherein the proximal end is elevated with respect to the distal end, and a ball guide, the ball guide defining a ball path down the ramp from the proximal end to the distal end;

a base located at the proximal end of the ramp for supporting the ramp, wherein the ramp is pivotally coupled to the base for allowing movement of the ramp with respect to the base;

a ball release coupled to the ramp along the ball guide, wherein the ball release and the ball guide define a ball starting position along the ball path down the ramp and wherein the ball release is positioned along a distal side of the ball starting position, the ball release including a stopping member being moveable between a blocking position restricting the ball from traveling along the ball guide, and a releasing position allowing the ball unrestricted travel along the ball guide;

a first and a second motor coupled to the ramp, wherein the first motor is located along a first side of the ramp and the second motor is located along the second side of the ramp, and wherein each motor has a wire extending therefrom and being coupled to the distal end of the ramp, wherein control of the lengths of the wires by the motors provides movement of the ramp to a desired orientation; and a control box having a switch coupled to the ball release for selectively controlling the position of the stopping member, and a position control operationally coupled with the first and the second motors for directing the first and second motors to adjust the length of the wires.

8. The ramp assembly of claim 7, wherein the ball release further includes a solenoid coupled to the ramp, stopping member, and switch, the solenoid moving the stopping member between the blocking position and the releasing position, and the solenoid being electrically actuated by the switch.

9. The ramp assembly of claim 7, wherein the control box is electrically coupled to the ball release and the switch includes one of a button controlled switch, a puff switch, a head position controlled switch, or any other ability switch.

10. The ramp assembly of claim 7, wherein the base and ramp are constructed of tubes having a strength sufficient to support a bowling ball.

* * * * *